United States Patent [19]

Desclos

[11] Patent Number: 5,013,962

[45] Date of Patent: May 7, 1991

[54] SINGLE PIN LAMP BASE AND FLUORESCENT LAMP INCLUDING SAME

[75] Inventor: Raymond G. Desclos, Ipswich, Mass.

[73] Assignee: GTE Products Corporation, Danvers, Mass.

[21] Appl. No.: 457,227

[22] Filed: Dec. 26, 1989

[51] Int. Cl.[5] ..... H01J 5/50; H01K 1/44

[52] U.S. Cl. ..... 313/318; 439/612; 439/236

[58] Field of Search ..... 313/318; 439/236, 612

[56] References Cited

U.S. PATENT DOCUMENTS

| | | | |
|---|---|---|---|
| 2,386,190 | 10/1945 | Betts | 439/612 |
| 3,014,196 | 12/1961 | Shappel | 313/318 |
| 3,993,386 | 11/1976 | Rowe | 439/236 |
| 4,854,888 | 8/1989 | Cannon | 439/236 |

*Primary Examiner*—Donald J. Yusko

*Assistant Examiner*—Diab Hamadi

*Attorney, Agent, or Firm*—Carlo S. Bessone

[57] ABSTRACT

A single pin base for a fluorescent lamp comprises first and second base members. The first base member includes a shell, a first disk of insulating material secured to or formed from the shell, and a contact member centrally mounted on the disk and adapted to receive the lead-in wire from one end of the fluorescent lamp. The second base member includes a second disk of insulating material and a single contact pin centrally mounted on the second insulating disk. A metal disk is located within and secured to the single contact pin and is provided with an aperture formed therein for receiving the contact member of the first base member and for frictionally engaging the contact member so that the second base member is retained on the first base member.

13 Claims, 2 Drawing Sheets

SINGLE PIN LAMP BASE AND FLUORESCENT LAMP INCLUDING SAME

FIELD OF THE INVENTION

This invention relates in general to a base for electric lamps and pertains, more particularly, to a two-piece single pin base for a fluorescent lamp.

BACKGROUND OF THE INVENTION

In the manufacture of a fluorescent lamp, a base having one or more terminals or pins extending therefrom is generally provided at each end of the lamp. Electrical energy connected to the base pin(s) is coupled by means of lead-in wires to an electrode located at each end of the lamp. The lead-in wires are electrically connected to the base pins by means of crimping, soldering or welding.

U.S. Pat. No 3,014,196, which issued on Dec. 19, 1961, relates to a single pin base for a fluorescent lamp. The two lead-in wires at each end of the lamp are helically twisted to provide a single, composite wire. This composite wire is welded to the proximal surface of a metal disk located within the pin. This technique of welding a composite wire to an internal metal disk within the pin has several disadvantages associated therewith. First, during the high-speed manufacturing assembly of the lamp, it is often difficult to adequately control the positioning of the lead-in wire onto the metal disk resulting in poor welds or no welds. Second, bulb side shifting during lamp manufacturing can cause poor welds and no welds. Third, manufacturing equipment used to helically twist the lead-in wires requires high maintenance and is difficult to adjust. Often, loose twists and large and too small loops are formed which may contact the metallic base shell creating a short-circuit in the base.

SUMMARY OF THE INVENTION

It is, therefore, an object of the present invention to obviate the disadvantages of the prior art.

It is still another object of the invention to provide an improved base for a fluorescent lamp.

It is another object of the invention to provide a lamp base which can be connected without welding the lead-in wires to a metal disk located within a base pin as taught by the prior art.

These objects are accomplished in one aspect of the invention by the provision of a single pin base for a fluorescent lamp comprising first and second base members. The first base member includes a shell, a first disk of insulating material secured to or formed from the shell, and a contact member centrally mounted on the disk and adapted to receive at least one lead-in wire from the fluorescent lamp. The second base member includes a second disk of insulating material and a single contact pin centrally mounted on the second disk. A metal disk is located within and secured to the single contact pin and is provided with an aperture formed therein for receiving the contact member of the first base member and for frictionally engaging the contact member so that the second base member is retained on the first base member.

In accordance with further teachings of the present invention, the shell is formed from metal and includes an annular flange formed therein for retaining the first disk.

In accordance with further aspects of the present invention, the metal disk of the single pin includes a plurality of tabs formed therein. Each of the tabs has a free end which engages the contact member. Preferably, the metal disk includes a pair of oppositely disposed tabs.

The above objects are further accomplished in another aspect of the invention by the provision of a method of manufacturing a fluorescent lamp comprising the steps of providing a sealed fluorescent envelope containing an ionizable medium and an internal phosphor coating and having an end thereof containing at least one lead-in wire extending therefrom. A two-member base for the lamp is provided.

The first member of the base includes a shell, a first disk of insulating material secured to the shell and a contact member centrally mounted on the first disk and adapted to receive the lead-in wire from the sealed fluorescent envelope. A lead-in wire is threaded through the proximal end of the contact member of the first base member and electrically connected to the contact member, for example, by crimping. The shell of the first base member is affixed to the end of the envelope.

A second member of the base includes a second disk of insulating material, a single contact pin centrally mounted on the second disk, and a metal disk securedly located within the single contact pin and having an aperture formed therein and adapted to receive and frictionally engage the contact member. The contact member is passed through the aperture in the metal disk of the base Pin whereby removal of the second base member is substantially prevented as a result of friction between the apertured metal disk and the contact member.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
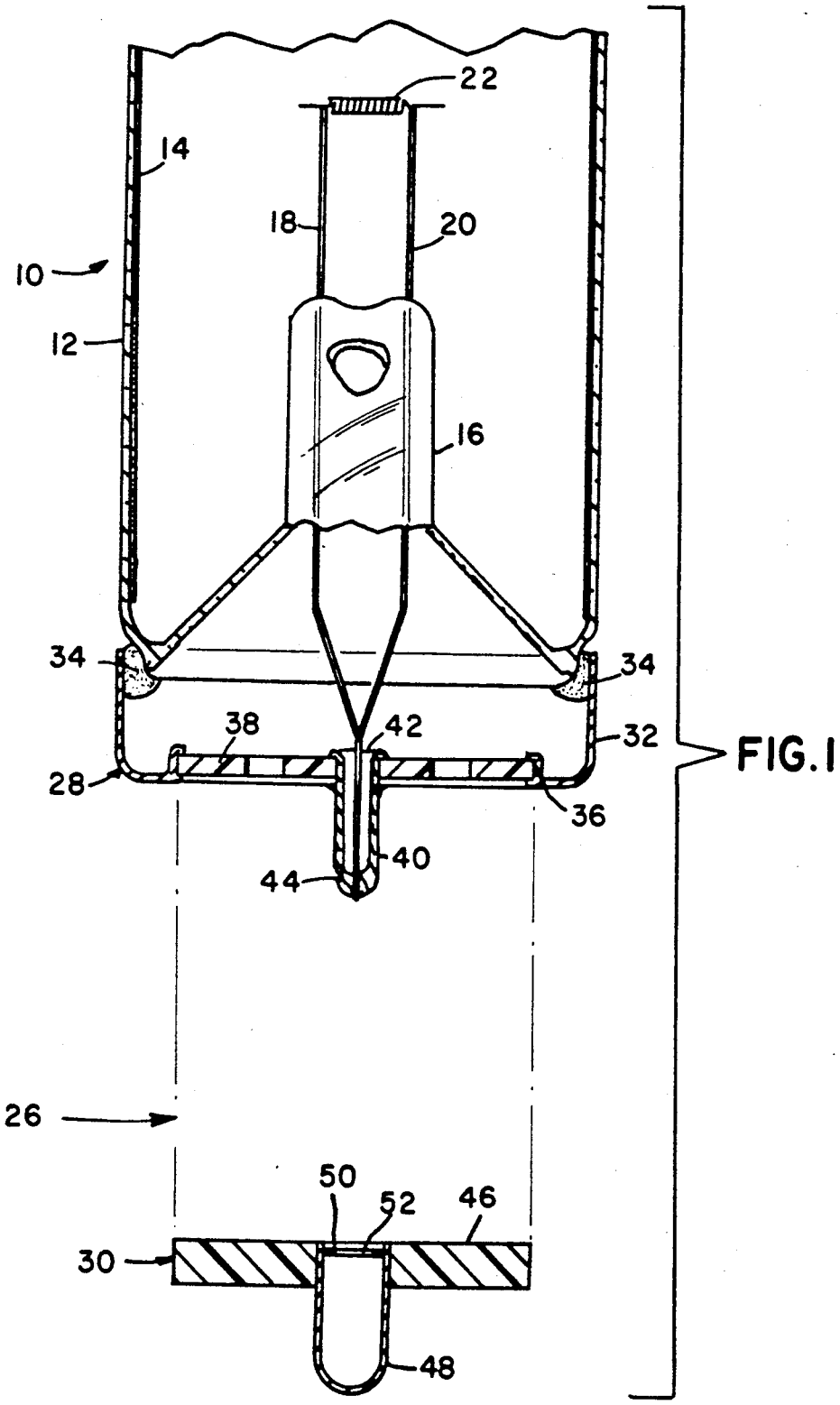
FIG. 1 represents an exploded elevational view, in cross section, of an embodiment of a fluorescent lamp having a two-piece single pin base according to the present invention.
Figure 2:
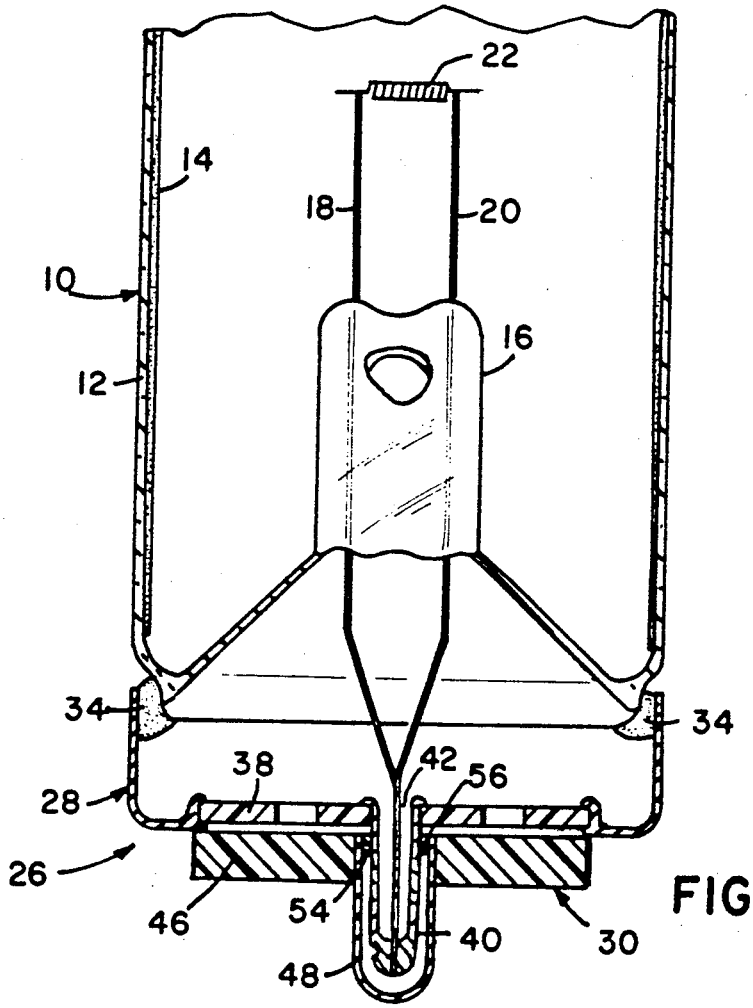
FIG. 2 is an elevational, cross sectional view of the fluorescent lamp of FIG. 1.

Referring to FIGS. 1 and 2 of the drawings, an instant-start fluorescent lamp 10 includes an elongated glass envelope 12 having a coating of phosphors 14 disposed on the inner wall surface. Each end of fluorescent lamp 10 (only one end being shown) includes a glass stem member 16 sealed into the end of envelope 12 and having a pair of electrical leads 18 and 20 sealed therein and passing therethrough.

An electrode 22 is located within each end of envelope 12 and connected at opposite ends to the upper portion of electrical leads 18 and 20. Electrode 22, which is frequently referred to as a filament or cathode, is of a well-known type used in fluorescent lamps and usually includes a tungsten coil having an emissive material thereon in the form of alkaline earth oxides which were applied in the form of carbonates and processed to provide the oxides.

Envelope 12 contains an ionizable medium including a quantity of mercury and a gas fill generally selected from the group consisting of argon, krypton, neon, helium and combinations thereof at a pressure from about 1.0 to 4.0 torr.

A two-piece single pin lamp base 26 is provided at each end of fluorescent lamp 10 and includes a first base member 28 and a second base member 30. First base member 28 comprises a shell 32, a disk 38 of insulating material, and a contact member 40 centrally mounted on disk 38. Shell 32 may be made of metal and may be provided with an annular flange 36 which locks insulating disk 38 in place. It is also possible to form the shell and associated disk as a single contiguous unit composed of insulating material. Basing cement 34 affixes shell 32 to the end of lamp envelope 12.

While a filament electrode 22 having a pair of lead-in wires 18, 20 extending therefrom is depicted in FIGS. 1 and 2, it is readily apparent to those skilled in the art that the teachings of the present invention may be applied to other types of electrodes. For example, the electrode may be in the form of a cold cathode or may be specifically designed for d.c. operation and have an anode electrode in the form of a metal plate. In each case, the cold cathode or anode plate is supported by a single lead-in wire.

Contact member 40 is provided with an aperture 42 extending therethrough for receiving one or more lead-in wires. In FIGS. 1 and 2, a portion of both lead-in wires is shown extending within aperture 42 of contact member 40. The two lead-in wires may be helically twisted to provide a single composite wire prior to insertion into contact member 40. Preferably, the lead-in wires are electrically connected to contact member 40 by means of a crimp 44. Alternatively, the electrical connection to contact member can be made by soldering or welding. Contact member 40 is mounted on disk 38, for example, by staking.

Figure 3:
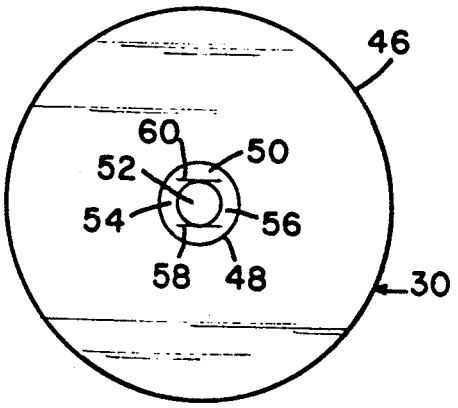
FIG. 3 is a plan view of the inner surface of one member of the single pin base.

As further illustrated in FIGS. 1-3, second base member 30 includes a disk 46 of insulating material having a centrally mounted contact pin 48 secured thereto. A metal disk 50 is fixedly located within contact pin 48 and is provided with an aperture 52 for receiving contact member 40. A pair of retaining tabs 54, 56 (FIGS. 2 and 3) is formed in metal disk 50. Before assembly of the two-piece base, the distance between retaining tabs 54, 56 is slightly less than the diameter of contact member 40. As a result, the free end of tabs 54, 56 (i.e., adjacent aperture 52) are distorted inwardly during assembly (see FIG. 2) by contact member 40 entering aperture 52. A frictional force between the free end of tabs 54, 56 and contact member 40 substantially prevents removal of second base member 30 from first base member 28. It is unnecessary to use addition means (e.g., adhesive or rivets) to retain the two members of the base together. As best illustrated in FIG. 3, tabs 54, 56 are formed by making a pair of parallel slits 58, 60 in metal disk 50 adjacent aperture 52.

In assembling the fluorescent lamp according to the teachings of the present invention, a sealed fluorescent tube having at least one lead-in wire extending from an end thereof is present. If two lead-in wires from the electrode are provided, both lead-in wires are threaded through the proximal end of contact member of the first base member. Any excess wire which may pass through the distal end of the contact member is severed and discarded. Alternatively, a shortened lead-in wire may be helically wrapped around the other lead-in wire, the latter of which is threaded through the contact member. Next, the lead-in wires are electrically connected to the contact member by means of crimping, soldering or welding. The metal shell of the first base member is affixed to the end of the lamp envelope by means of basing cement. Next, the contact member of the first base member is passes through the aperture formed in the metal disk of the base pin until the insulative disks of the two base members are substantially flush with each other. The friction of the apertured metal disk on the contact member substantially prevents removal of the second base member from the first base member.

There has thus been shown and described an improved single pin base for a fluorescent lamp. The lead-in wires of the lamp are connected to the lamp base without the need for welding the lead-in wires to a metal disk located within a base pin. As a result, lamp defects caused by Poor welds, no welds and shorted bases are eliminated.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A single pin base for a lamp having at least one lead-in wire extending from an end thereof, said base comprising:

a first base member including a shell, a first disk of insulating material secured to or formed from said shell, and a contact member centrally mounted on said first disk and adapted to receive and electrically engage said at least one lead-in wire from said lamp; and a second base member including a second disk of insulating material, a single contact pin centrally mounted on said second disk, a metal disk located within and secured to said single contact pin, said metal disk having an aperture formed therein for receiving said contact member of said first base member and adapted to frictionally engage said contact member whereby said second base member is retained on said first base member.

2. The single pin base according to claim 1 wherein said shell of said first base member is metal.

3. The single pin base according to claim 2 wherein said shell includes an annular flange for retaining said first disk.

4. The single pin base according to claim 1 wherein said at least one lead-in wire is electrically connected to said contact member by crimping.

5. The single pin base according to claim 1 wherein said metal disk includes a plurality of tabs formed therein, each of said tabs having a free end which engages said contact member.

6. The single pin base according to claim 5 wherein said metal disk includes a pair of oppositely disposed tabs.

7. A method of manufacturing a fluorescent lamp comprising the steps of:

providing a sealed fluorescent envelope containing an ionizable medium and an internal phosphor coating and having an end thereof containing at least one lead-in wire extending therefrom;

providing a first base member including a shell, a first disk of insulating material secured to or formed from said shell and a contact member centrally mounted on said first disk and adapted to receive said at least one lead-in wire from said sealed fluorescent envelope;

threading said at least one lead-in wire through the proximal end of said contact member of said first base member;

electrically connecting said at least one lead-in wire to said contact member;

affixing said shell of said first base member to the end of said envelope;

providing a second base member including a second disk of insulating material, a single contact pin centrally mounted on said second disk, and a metal disk securedly located within said single contact pin and having an aperture formed therein and adapted to receive and frictionally engage said contact member; and passing said contact member through said aperture in said metal disk of base pin whereby removal of said second base member is substantially prevented as a result of friction between said apertured metal disk and said contact member.

8. The method of manufacturing a fluorescent lamp according to claim 7 further including the step of forming a plurality of tabs in said metal disk with each of said tabs having a free end for engaging said contact member.

9. The method of manufacturing a fluorescent lamp according to claim 8 wherein said step of forming a plurality of tabs includes forming a pair of oppositely disposed tabs.

10. The method of manufacturing a fluorescent lamp according to claim 7 further including the step of forming an annular flange in said shell for retaining said first disk.

11. The method of manufacturing a fluorescent lamp according to claim 7 further including the step of crimping said at least one lead-in wire to said contact member.

12. The method of manufacturing a fluorescent lamp according to claim 7 further including the step of helically twisting a pair of lead-in wires to form a composite wire and threading said composite wire through said proximal end of the contact member.

13. A fluorescent lamp comprising:

a sealed envelope containing an ionizable medium and an internal phosphor coating and having at least one lead-in wire extending from an end thereof;

a first base member affixed to said end of said envelope and including a shell, a first disk of insulating material secured to or formed from said shell and a contact member centrally mounted on said first disk and adapted to receive said at least one lead-in wire; and a second base member including a second disk of insulating material, a single contact pin centrally mounted on said second disk, and a metal disk securedly located within said single contact pin and having an aperture formed therein and adapted to receive and frictionally engage said contact member whereby removal of said second base member is substantially prevented.

* * * * *